US005850860A

United States Patent [19]

Memelink

[11] Patent Number: 5,850,860

[45] Date of Patent: Dec. 22, 1998

[54] WOOD TURNING TOOL

[76] Inventor: Harry Memelink, 417 Cuba Street Petone, Wellington 6008, New Zealand

[21] Appl. No.: 776,800

[22] PCT Filed: Aug. 10, 1995

[86] PCT No.: PCT/NZ95/00073

§ 371 Date: Jun. 25, 1997

§ 102(e) Date: Jun. 25, 1997

[87] PCT Pub. No.: WO96/05032

PCT Pub. Date: Feb. 22, 1996

[30] Foreign Application Priority Data

Aug. 11, 1994 [NZ] New Zealand ..... 264224

[51] Int. Cl.[6] ..... B27C 7/00; B27G 15/00

[52] U.S. Cl. ..... 142/56; 407/4

[58] Field of Search ..... 142/56; 407/2–4

[56] References Cited

U.S. PATENT DOCUMENTS

| | | | |
|---|---|---|---|
| 419,873 | 1/1890 | Palmer | 142/56 |
| 2,101,379 | 12/1937 | Zackowitz | 142/56 |
| 2,986,177 | 5/1961 | Markin | 142/56 |
| 4,126,165 | 11/1978 | Guignard et al. | 142/56 |
| 4,284,111 | 8/1981 | Petersen et al. | 142/56 |
| 4,754,787 | 7/1988 | Smith | 142/56 |

FOREIGN PATENT DOCUMENTS

| | | |
|---|---|---|
| 64407/80 | 7/1981 | Australia . |
| 33267/84 | 1/1986 | Australia . |
| 2 129 730 | 5/1984 | United Kingdom . |

OTHER PUBLICATIONS

J. Blackwood & Son Limited, Blackwoods General Catalog, 1979, p. 214, Macarthur Press Pty. Limited, Australia.

*Primary Examiner*—Steven C. Bishop
*Attorney, Agent, or Firm*—Zarley, McKee, Thomte, Voorhees & Sease

[57] ABSTRACT

One preferred embodiment of the invention comprises a wood turning tool comprising a handle portion (1) and a cutting portion (2). The cutting portion comprises a blade (3) which has closed curve cutting edges. The tool comprises a deflector (14) for preventing the cutting portion from becoming blocked by wood shavings. The tool also comprises a blade cover (11) which can move across the blade (3) to regulate the cutting capacity of the tool. A threaded cylindrical member (12) can be manually operated to reversibly move the blade cover (11) across the blade (3).

12 Claims, 3 Drawing Sheets

WOOD TURNING TOOL

TECHNICAL FIELD

This invention relates to cutting means. In particular, one preferred form of the invention relates to a cutting tool for use in wood turning.

BACKGROUND ART

It is known in the art to use tools which comprise a sharp blade for fashioning a piece of wood as it spins on a lathe. However, a problem with many known tools is that they have a blade construction with insufficient strength, and hence blade breakage is an all too common occurrence. Additionally, some known tools have a very limited cutting capacity, or are prone to inconvenient blockage by wood shavings. It is therefore an object of at least one embodiment of the present invention to go at least some way towards overcoming the above problems.

DISCLOSURE OF INVENTION

According to one aspect of the invention there is provided cutting means comprising a support portion and a blade portion, the blade portion being in the form of at least one closed curve or loop and having a cutting edge extending at least partially around the closed curve or loop.

In one embodiment of the invention the cutting means comprises clearance means, the cutting means being formed such that when it is used to cut an object the clearance means is suitable for use in clearing cuttings from the object away from an area adjacent the blade portion.

Preferably the clearance means comprises a deflecting portion which can be arranged adjacent the blade portion to deflect cuttings away from the blade portion.

In one alternative embodiment of the invention the clearance means comprises an aperture which can receive an implement for pushing cuttings away from the blade portion.

In another embodiment of the invention there is provided cutting means according to any one of the four immediately preceding paragraphs, comprising adjustment means for regulating the cutting capacity of the blade portion.

Preferably the adjustment means comprises cover means which can be reversibly moved over or across at least part of the blade portion.

Preferably the cover means comprises a cover cap and a stem.

In a further embodiment of the invention there is provided cutting means according to any one of the seven immediately preceding paragraphs, wherein the cutting edge has varying degrees of curvature as it extends at least partially around the closed curve or loop.

Preferably the blade portion is in the form of two closed curves or loops, each closed curve or loop having a cutting edge extending at least partially around the closed curve or loop.

Preferably any one of the cutting edges can be arranged in a position suitable for cutting, but both cutting edges can not be in the position suitable for cutting at the same time.

Preferably the cutting edges are offset from a support plate.

In some embodiments of the invention the closed curve or loop comprises at least one substantially straight part. In some embodiments of the invention all parts of the loop may be straight.

Some preferred embodiments of the invention will now be described by way of example and with reference to the accompanying drawings, of which:

Figure 1:
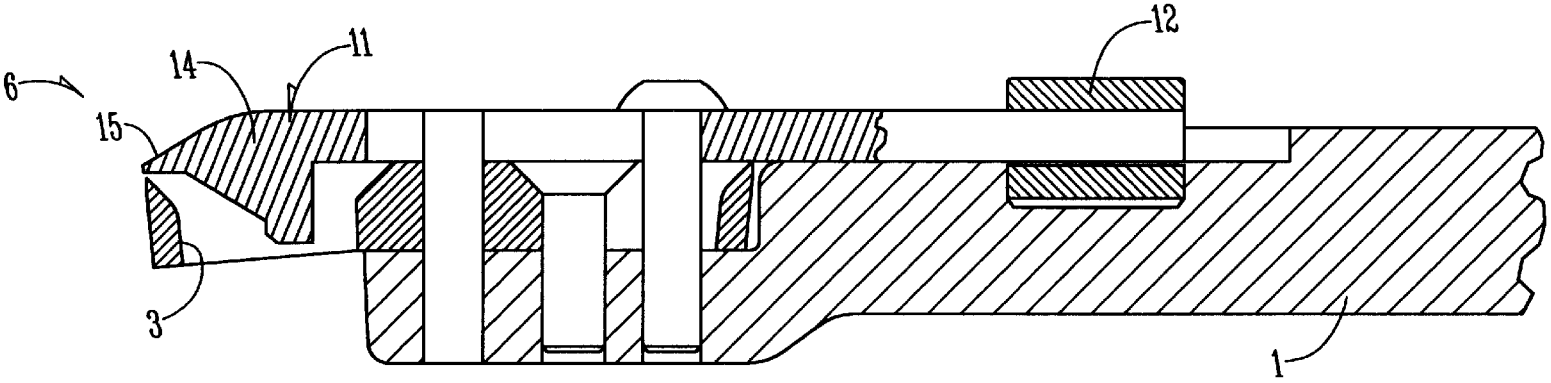
FIG. 1 is a side cross-section view of an adjustable wood turning tool.
Figure 3:
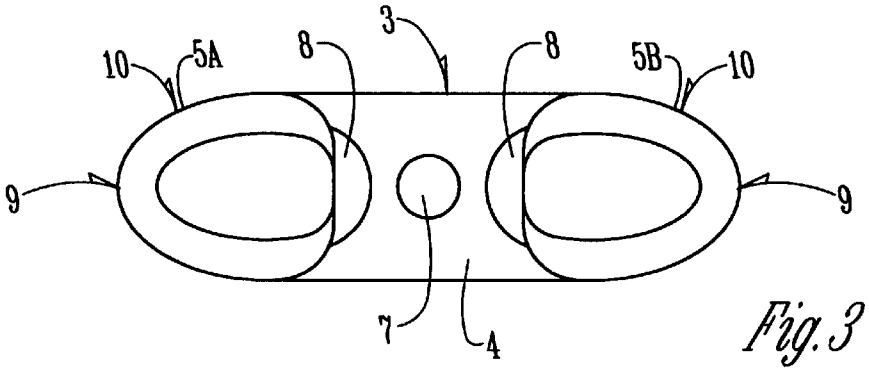
FIG. 3 is a plan view of a blade which forms part of the tool shown in FIG. 1.
Figure 2:
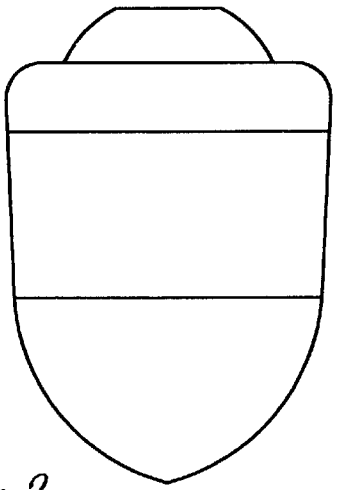
FIG. 2 is an end elevation view of the tool shown in FIG. 1.

With reference to FIGS. 1 and 3, the adjustable wood turning tool comprises a handle portion 1 which supports a cutting portion 2. The cutting portion 2 includes a blade 3 which is formed from a plate 4 supporting two closed curve cutting edges 5*a* and 5*b*. As shown, the closed curves are not circular, but rather have varying degrees of curvature. The plate 4 is secured to the rest of the cutting portion 2 such that only one of the cutting edges 5*a* or 5*b* is in a suitable position (the cutting position) at the front end 6 of the tool to cut a piece of wood at any one time. However, it should be noted that the plate 4 can be loosened and rotated 180° so that the cutting edges 5*a* and 5*b* can be interchangeably moved to the cutting position. As shown in FIG. 3, the plate 4 has a central hole 7 to enable it to be secured against the rest of the tool by way of a hardened dowel or some other suitable fixing means. As also shown in FIG. 3, the cutting edges 5*a* and 5*b* are off-set from the plate 4 by way of support portions 8 which extend outwardly from the plate 4. Preferably both the front end 9 and the side parts 10 of each cutting edge 5*a* and 5*b* are sufficiently sharp to enable cutting of the wood.

Figure 4:
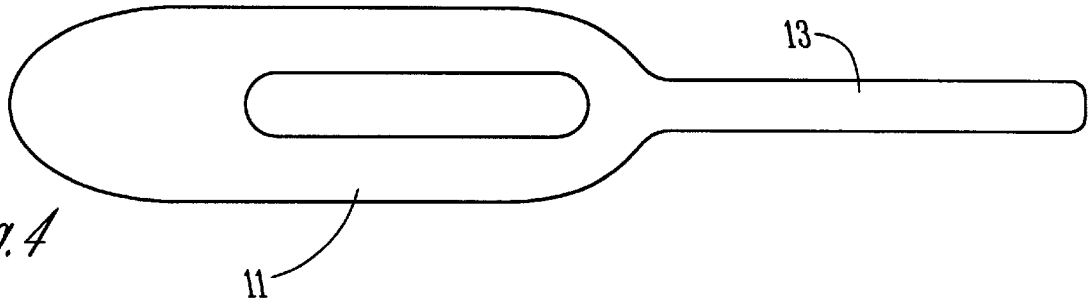
FIG. 4 is an upper plan view of a blade cover which forms part of the tool shown in FIG. 1.

As shown in FIGS. 1 and 4, the tool includes a blade cover 11 which can be moved forward and backward across the cutting edge 5*a* or 5*b* which is in the cutting position. By moving the blade cover 11 in this way the amount of the cutting edge 5*a* or 5*b* which is exposed for cutting the wood can be regulated. Those skilled in the art will appreciate that regulating the amount of the cutting edge which is exposed enables the cutting depth of the tool to be adjusted.

To control the forward and backward movement of the blade cover 11 the tool comprises a threaded cylindrical member 12 as shown in FIG. 1. The cylindrical member 12 receives a stem 13 of the blade cover 11. The stem 13 is most clearly shown at FIG. 4. The threaded cylindrical member 12 can be manually rotated to cause forward and backward movement of the stem 13, which in turn causes movement of the portion of the blade cover 11 which extends across the cutting edge 5*a* or 5*b*.

Figure 5:
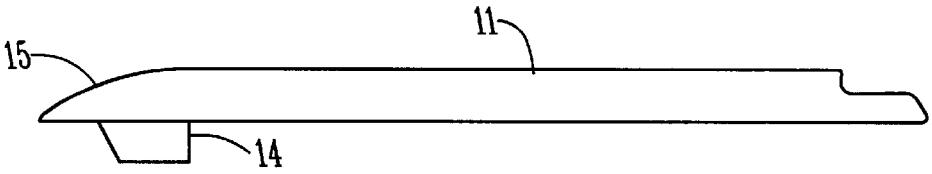
FIG. 5 is a side elevation view of the blade cover.
Figure 6:
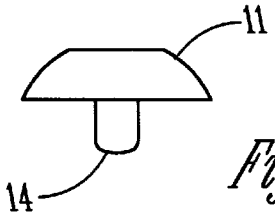
FIG. 6 is a front end elevation view of the blade cover.
Figure 7:
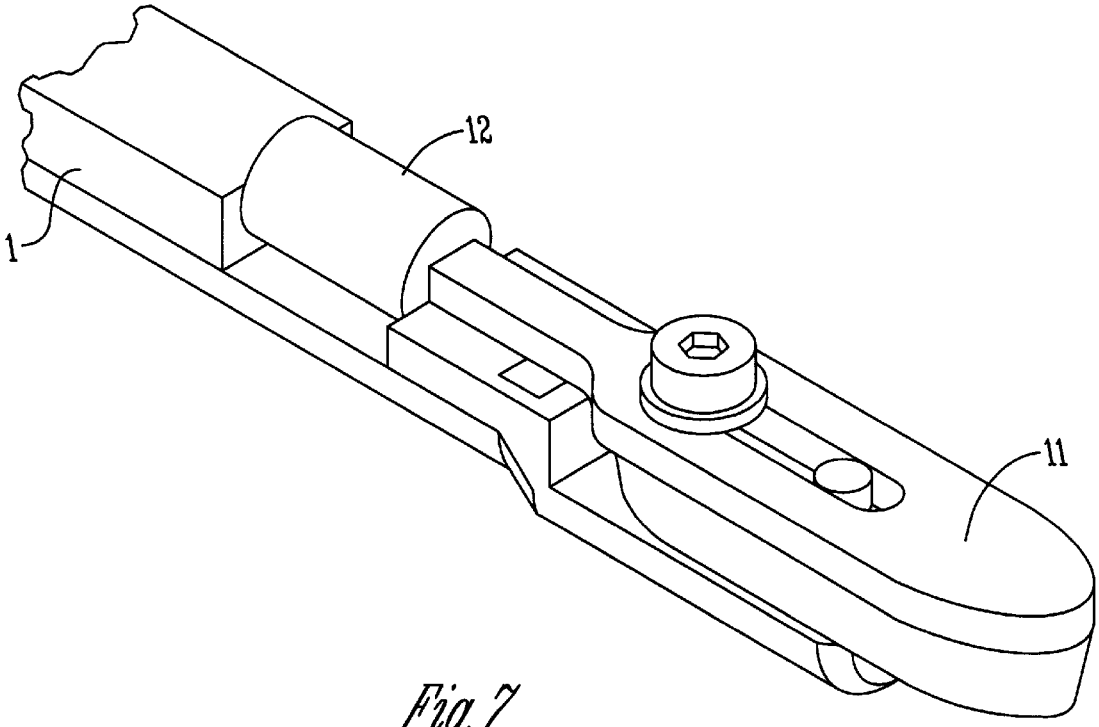
FIG. 7 is a perspective view of the adjustable wood turning tool.

With reference to FIGS. 1, 5 and 6, the blade cover 11 includes a downwardly projecting deflector 14. As can be most clearly seen from FIGS. 1 & 5, the deflector 14 is positioned slightly short of the most forward end 15 of the blade cover 11. As shown in FIG. 1, the deflector 14 extends partially through the closed curve cutting edge 5*a* or 5*b* which is in the cutting position. Because the deflector 14 forms part of the blade cover 11 it moves with the rest of the blade cover in response to rotation of the cylindrical member 12.

When the tool is in use the blade cover 11 is moved across the top of the cutting edge 5*a* or 5*b* which is in the cutting position so that the tool is set to the desired cutting depth. The person using the tool then takes hold of the handle portion 1 and moves the cutting edge 5*a* or 5*b* which is in the cutting position to contact the surface of a piece of wood which is spinning in a lathe. The cutting edge 5*a* or 5*b* which is in the cutting position causes wood shavings to be cut from the piece of wood and move through the closed curve of the same cutting edge. The wood shavings contact the deflector 14 and are deflected away to prevent blocking of the area within or immediately adjacent the closed curve cutting edge 5*a* or 5*b* which is in the cutting position.

In some alternative embodiments of the invention there may be an aperture in the blade cover 11 so that an implement can be inserted therein for pushing away any build-up of wood shavings. In this embodiment the deflector 14 may or may not be dispensed with.

While some preferred embodiments of the invention have been described by way of example it should be appreciated that modifications and improvements can occur without departing from the scope of the appended claims.

I claim:

1. Cutting means, comprising a support portion, a blade portion, a deflecting portion, and a cover which can be positioned substantially over or across the blade portion to determine a cutting capacity of the cutting means, the blade portion being in the form of at least one closed curve or loop and having a cutting edge extending at least partially around the closed curve or loop, the deflecting portion being integral with and extending from the cover and being capable of extending at least partially into the closed curve or loop when the cutting means is in use, the cutting means being formed such that when it is used to cut an object the deflecting portion is suitable for deflecting cuttings from the object away from an area adjacent the blade portion so as to at least substantially prevent blockage of the blade portion by the cuttings.

2. Cutting means according to claim 1, wherein the deflecting portion is substantially in the shape of a keel.

3. Cutting means according to claim 1, wherein the cover can be set to any one of a variety of positions over or across at least part of the blade portion to enable the cutting capacity of the cutting means to be regulated.

4. Cutting means according to claim 3, wherein the cover comprises a cover and a stem.

5. Cutting means according to claim 1, wherein the cutting edge has varying degrees of curvature as it extends at least partially around the closed curve or loop.

6. Cutting means according to claim 1, wherein the blade portion comprises two closed curves or loops, each closed curve or loop having a cutting edge extending at least partially around the closed curve or loop.

7. Cutting means according to claim 6, wherein any one of the cutting edges can be arranged in a position suitable for cutting at the same time.

8. Cutting means according to claim 6, wherein the cutting edges are offset from a support plate.

9. Cutting means according to claim 1, wherein the cutting means is formed so that it is suitable as a wood turning tool.

10. Cutting means according to claim 1, wherein the support portion comprises a handle.

11. Cutting means according to claim 1, wherein the closed curve or loop comprises at least one substantially straight part.

12. Cutting means, comprising a support portion, a blade portion in the form of at least one closed curve or loop and having a cutting edge extending at least partially around the closed curve or loop, adjustment for regulating the cutting capacity of the blade portion, and a deflecting portion integral with the adjustment means and capable of extending from the adjustment means at least partially into the closed curve or loop, the cutting means being formed such that when it is used to cut an object the deflecting portion is able to deflect cuttings from the object away from an area adjacent the blade portion so as to at least substantially prevent blockage of the blade portion by the cuttings.

* * * * *